US009559476B2

(12) United States Patent
Straka et al.

(10) Patent No.: US 9,559,476 B2
(45) Date of Patent: Jan. 31, 2017

(54) ARJ45 TO RJ45 ADAPTER

(71) Applicant: Panduit Corp., Tinley Park, IL (US)

(72) Inventors: Frank M. Straka, Orland Park, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/706,480

(22) Filed: May 7, 2015

(65) Prior Publication Data

US 2016/0006200 A1 Jan. 7, 2016

Related U.S. Application Data

(60) Provisional application No. 61/990,897, filed on May 9, 2014.

(51) Int. Cl.

| | |
|---|---|
| ***H01R 31/06*** | (2006.01) |
| ***H01R 24/64*** | (2011.01) |
| ***H01R 24/68*** | (2011.01) |
| ***H01R 43/26*** | (2006.01) |
| *H01R 107/00* | (2006.01) |

(52) U.S. Cl.

CPC ..... *H01R 31/06* (2013.01); *H01R 24/64* (2013.01); *H01R 24/68* (2013.01); *H01R 43/26* (2013.01); *H01R 2107/00* (2013.01)

(58) Field of Classification Search

CPC ..... H01R 31/06; H01R 24/54; H01R 24/542

USPC ..... 439/638, 676, 639

See application file for complete search history.

(56) References Cited

U.S. PATENT DOCUMENTS

| | | | | |
|---|---|---|---|---|
| 5,328,390 | A * | 7/1994 | Johnston | H01R 31/02 439/638 |
| 6,419,527 | B2 | 7/2002 | Reichle | |
| 6,848,947 | B2 | 2/2005 | Chimiak | |
| 7,601,024 | B2 | 10/2009 | Martich | |
| 7,628,657 | B2 | 12/2009 | Martich | |
| 7,695,328 | B2 | 4/2010 | Martich | |
| 7,695,532 | B2 | 4/2010 | Chatterjee et al. | |
| 7,967,645 | B2 * | 6/2011 | Marti | H01R 13/6658 439/676 |
| 8,182,294 | B2 | 5/2012 | Martich et al. | |
| 8,758,047 | B2 | 6/2014 | Dietz et al. | |
| 2004/0235356 | A1 * | 11/2004 | Chimiak | H01R 33/94 439/638 |
| 2005/0186854 | A1 * | 8/2005 | Huang | H01R 31/06 439/677 |

(Continued)

FOREIGN PATENT DOCUMENTS

| | | | |
|---|---|---|---|
| DE | 202005010085 | U1 | 9/2005 |
| EP | 2088648 | A2 | 8/2009 |
| JP | 2006012861 | A | 1/2006 |

OTHER PUBLICATIONS

Bell Stewart Connector's ARJ45 HS Cat 7A to Cat 6A Standard Length Patch Cord Assembly; 1 page; Jan. 28, 2013.

*Primary Examiner* — Abdullah Riyami
*Assistant Examiner* — Harshad Patel
(74) *Attorney, Agent, or Firm* — Christopher S. Clancy; James H. Williams; Christopher K. Marlow

(57) ABSTRACT

A communication adapter that includes an RJ45 jack with a plurality of plug interface contacts and an ARJ45 plug including a plurality of plug contacts. The plug interface contacts are in electrical communication with the plug contacts. The RJ45 jack and the ARJ45 plug are connected by a housing.

2 Claims, 5 Drawing Sheets

(56) References Cited

U.S. PATENT DOCUMENTS

| | | | | |
|---|---|---|---|---|
| 2005/0282442 | A1* | 12/2005 | Hyland | H01R 31/005 439/676 |
| 2006/0046575 | A1* | 3/2006 | Allen | H01R 33/97 439/638 |
| 2013/0090011 | A1* | 4/2013 | Bolouri-Saransar | H01R 13/6461 439/620.15 |
| 2014/0154895 | A1* | 6/2014 | Poulsen | H01R 13/6463 439/76.1 |

* cited by examiner

ARJ45 TO RJ45 ADAPTER

CROSS-REFERENCE TO RELATED APPLICATIONS

This application claims priority to U.S. Provisional Patent Application No. 61/990,897, filed May 9, 2014, the subject matter of which is incorporated herein by reference in its entirety.

FIELD OF THE INVENTION

The present invention relates generally to plug adapters and specifically to an adapter for allowing a registered jack type 45 (RJ45) plug to electrically connect to an augmented registered jack type 45 (ARJ145) jack.

BACKGROUND OF THE INVENTION

The IEEE P802.3bq Task Force is currently working on a standard for 40GBASE-T. This standard includes requirements for a wide variety of parameters such as requirements for the PHY to PHY link 100 shown in FIG. 1. A PHY refers to a semiconductor chip in equipment, such as switch, which interfaces to the physical layer, and which transmits and receives data sent over a channel. This PHY to PHY link 100 includes the structured cabling 101 with elements such as a jack 102, horizontal cable 104, and patch cords 106. It also includes elements on the equipment 107 like a medium dependent interface (MDI or jack on the equipment) 108, magnetics on the equipment 110, and circuit board equipment traces 112 connecting the MDI to the magnetics and PHY chip 114. The overall performance of this PHY to PHY link 100 may be critical as better performance in this PHY to PHY link 100 implies that the PHY semiconductor chip 114 consumes less power and is be easier to design and manufacture, minimizing the time to market and maximizing the broad market potential.

The overall PHY to PHY channel performance for parameters like return loss and NEXT is essentially a summation of the structured cabling 101 and the elements on the equipment 107. Whatever PHY to PHY element has the worst performance generally dominates the overall channel performance and make improvements to any other element meaningless. The weakest point in a channel is may be magnetics 110, such as isolation transformers or other similar devices. Magnetics 110 provide port isolation but can cause parameters like return loss to be excessively high.

If it is decided to improve the performance or remove the magnetics, a limiting factor in the channel performance may be the structured cabling channel 101. Currently there are at least two approaches: an RJ45 path using F/UTP cabling and a switchable RJ45 path using S/FTP cabling. U.S. patent application Ser. Nos. 13/864,924 and 61/889,723, both of which are herein incorporated by reference in their entirety, show an ARJ45 plug design and a switchable jack design, respectively.

However, if equipment vendors decide to not adopt a switchable connector for the MDI 108 due to reliability or cost concerns, they may choose to adopt the simpler ARJ45 connector which offers the same benefit in performance without the backwards compatibility to RJ45. This may or may not present a compatibility concern depending on how the copper structure cabling solution is deployed.

Switchable RJ45 jacks can work well under a 40GBASE-T End of Row deployment. In this deployment scenario, copper is used to connect servers to a 40GBASE-T access switch. This can be done through switchable RJ45 switch cabinet jacks, horizontal cable, switchable RJ45 server cabinet jacks, and patch cords. In this case, if the servers are 10GBASE-T servers with RJ45 jacks, they can interface to the 40GBASE-T access switch by using Category 6A patch cords as patch cords. If the servers are upgraded to 40GBASE-T with ARJ45 jacks, then it is only necessary to switch patch cords to ARJ45 patch cords.

A Top of Rack deployment is becoming increasingly common within today's data centers, and is a likely deployment scenario for 40GBASE-T. The switchable RJ45 jack may not provide any benefit under a 40GBASE-T Top of Rack deployment. In the case of a Top of Rack deployment, copper patch cords may be used to directly connect servers to a fabric extender (which also can be an access switch). If a 40GBASE-T switch with an ARJ45 jack needs to interface with a 10GBASE-T server with an RJ45 jack, a hybrid patch cord is required with an ARJ45 plug on one end and a RJ45 plug on another end.

Many data center managers do not like having to maintain this extra hybrid patch cord inventory. There are also some concepts that suggest putting a switching RJ45 on the equipment as the MDI which can interface to both RJ45 plugs and ARJ45 plugs; however, this requires support for the MDI manufacturers. These MDI manufacturers may be cost sensitive and reluctant to invest in tooling for a complicated switching jack for which they may have low profit margins.

Therefore, it may be desirable to connect a non-switching ARJ45 jack on switch equipment with a 10GBASE-T port on a server, or other end equipment, using Category 6A RJ45 to RJ45 patch cords.

SUMMARY OF THE INVENTION

A communication adapter that includes an RJ45 jack with a plurality of plug interface contacts and an ARJ45 plug including a plurality of plug contacts. The plug interface contacts are in electrical communication with the plug contacts. The RJ45 jack and the ARJ45 plug are connected by a housing.

DETAILED DESCRIPTION OF THE PREFERRED EMBODIMENTS

Figure 1:
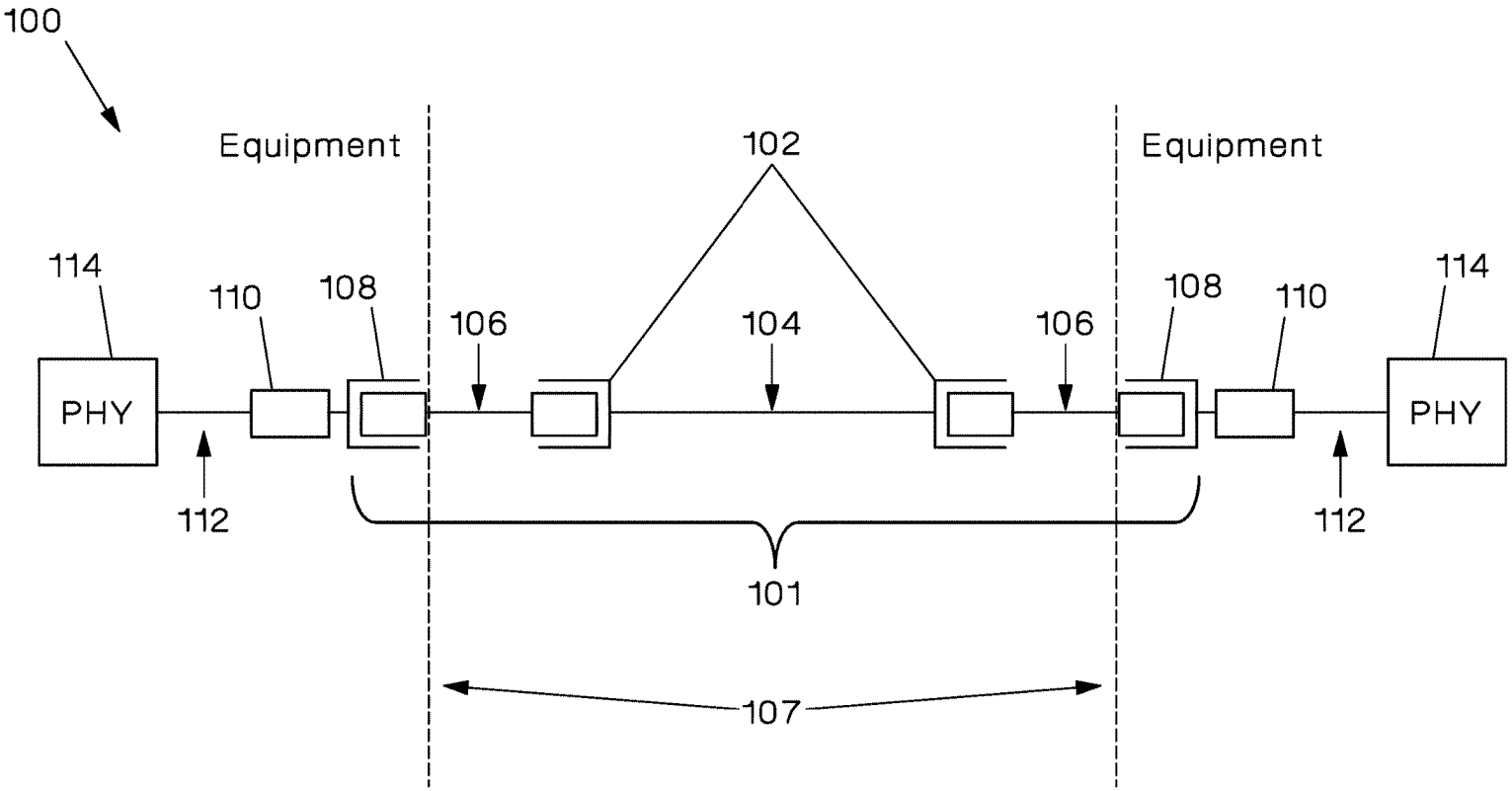
FIG. 1 shows a PHY to PHY link.
Figure 2:
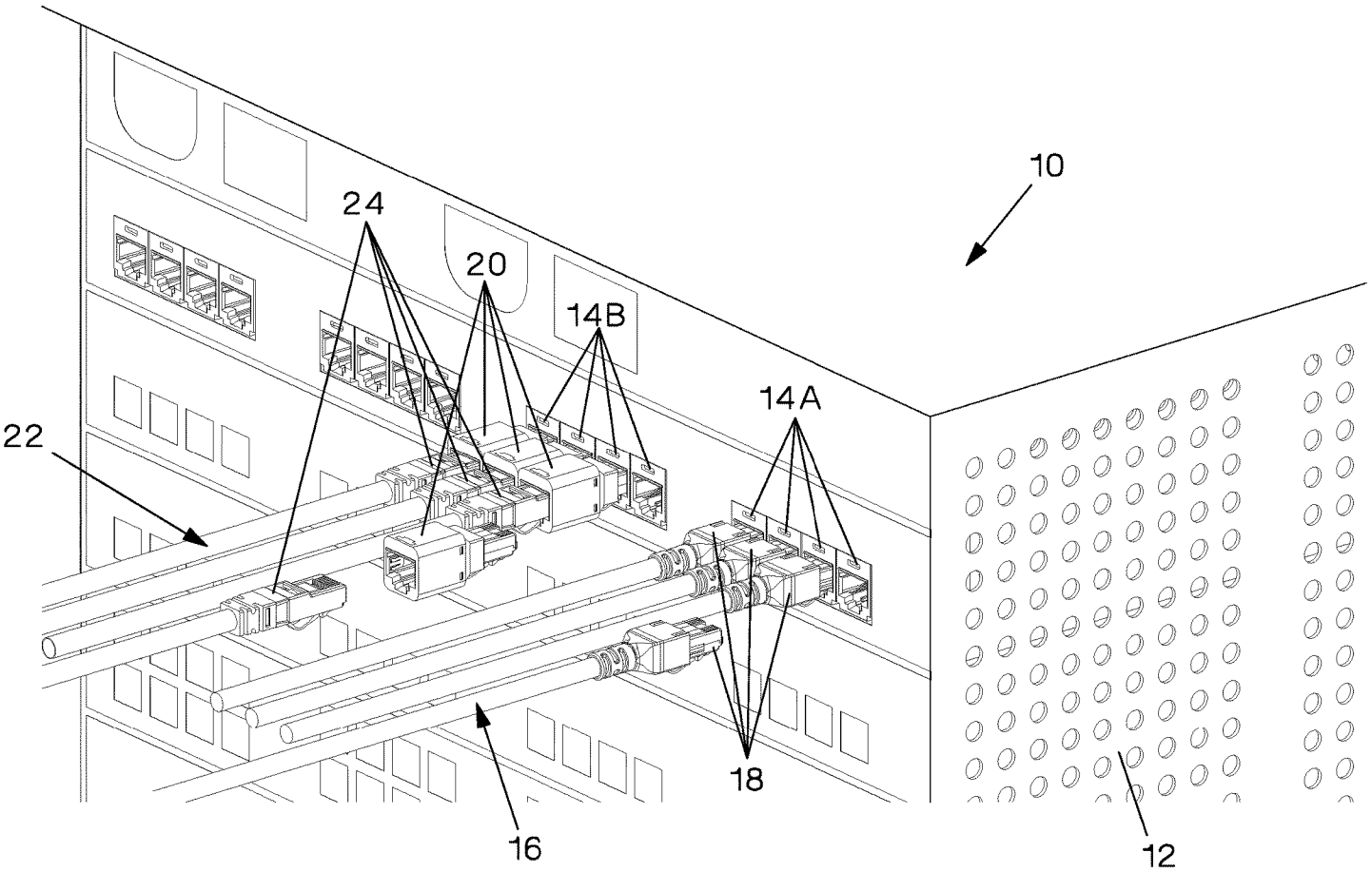
FIG. 2 is a perspective view of a communication system using an embodiment of an RJ45 to ARJ45 adapter.

A communication system 10, according to an embodiment of the present invention, is shown in FIG. 2 and includes a 40GBASE-T switch 12 with ARJ45 jacks 14A and 14B. 40GBASE-T patch cords 16 with ARJ45 plugs 18 connect directly to ARJ45 jacks 14A on switch 12. ARJ45 to RJ45 adapter modules 20 connect to ARJ45 jacks 14B on switch 12. Adapters 20 also connect to Category 6A patch cords 22 with RJ45 plugs 24. ARJ45 to RJ45 adapter 20 has now enabled the same 40GBASE-T switch 12 to interface with two different types of plugs without the need for any hybrid patch cords or switching MDI jacks.

Figure 3:
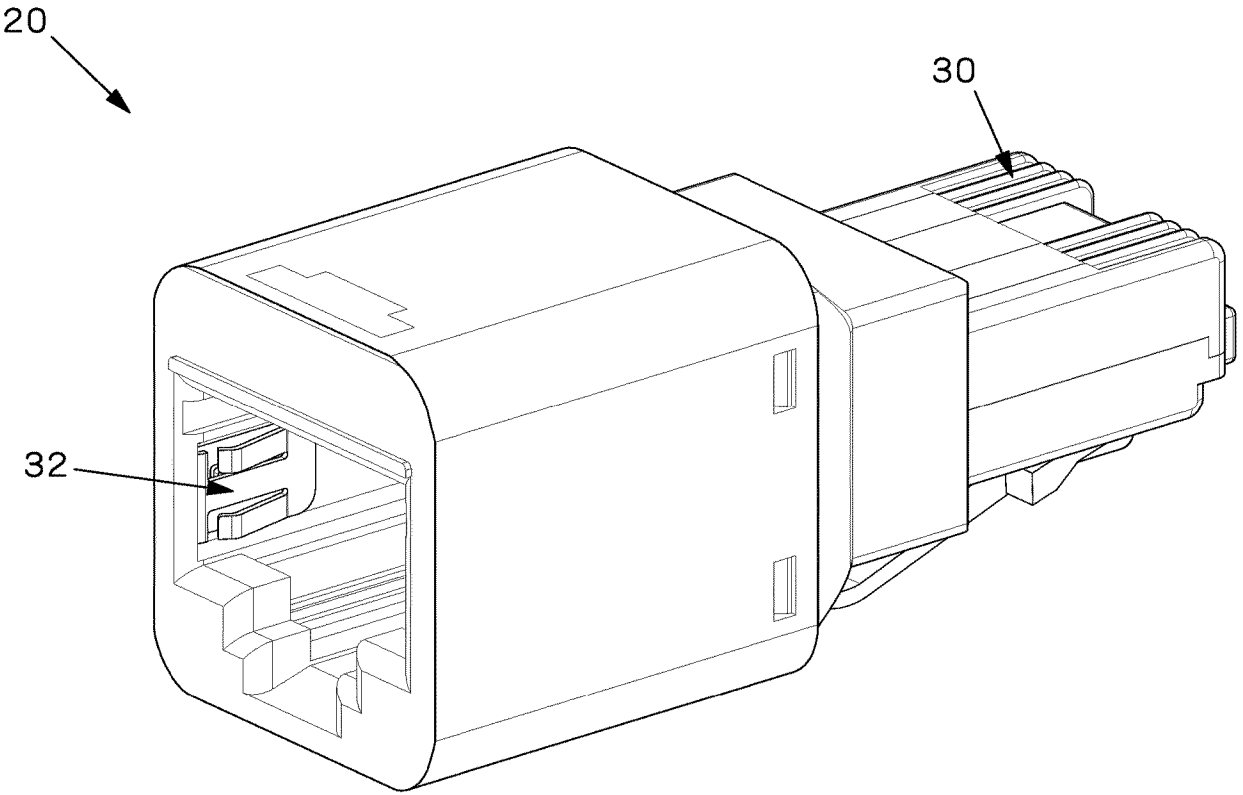
FIG. 3 is a perspective view of an embodiment of an RJ45 to ARJ45 adapter.

Referring to FIG. 3, adapter module 20 has an ARJ45 plug 30 at one end that can be inserted into an ARJ45 jack, and an RJ45 jack opening 32 on the other end that can accept a standard RJ45 plug. Adapter module 20 allows a switch or server to use a simpler MDI with ARJ45 jacks, while still maintaining backwards compatibility to RJ45 plugs without a switching connector or hybrid patch cord, and also allows a single 40GBASE-T switch to directly interface with both 40GBASE-T servers and 10GBASE-T servers by selectively using adapter modules 20.

Figure 4:
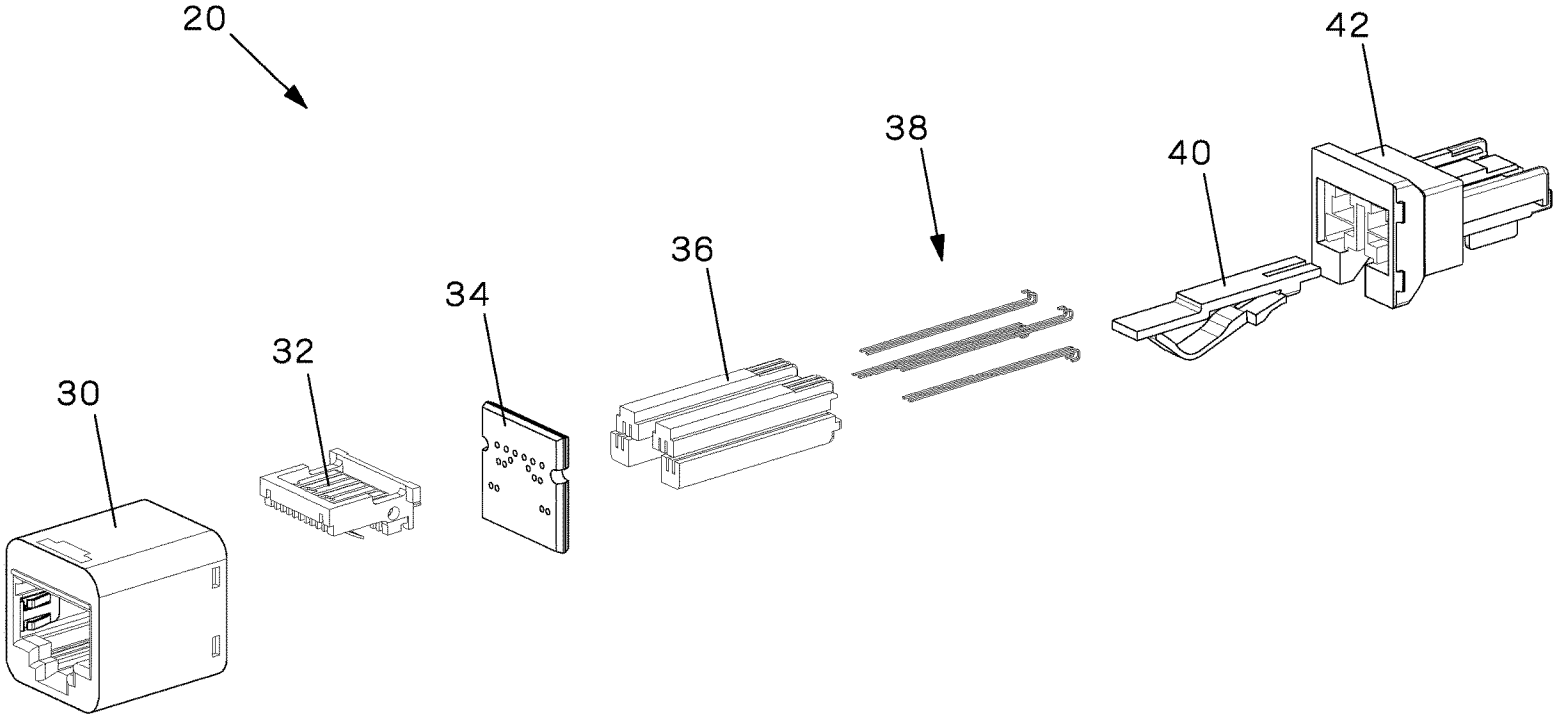
FIG. 4 is an exploded view of the adapter of FIG. 5.
Figure 5:
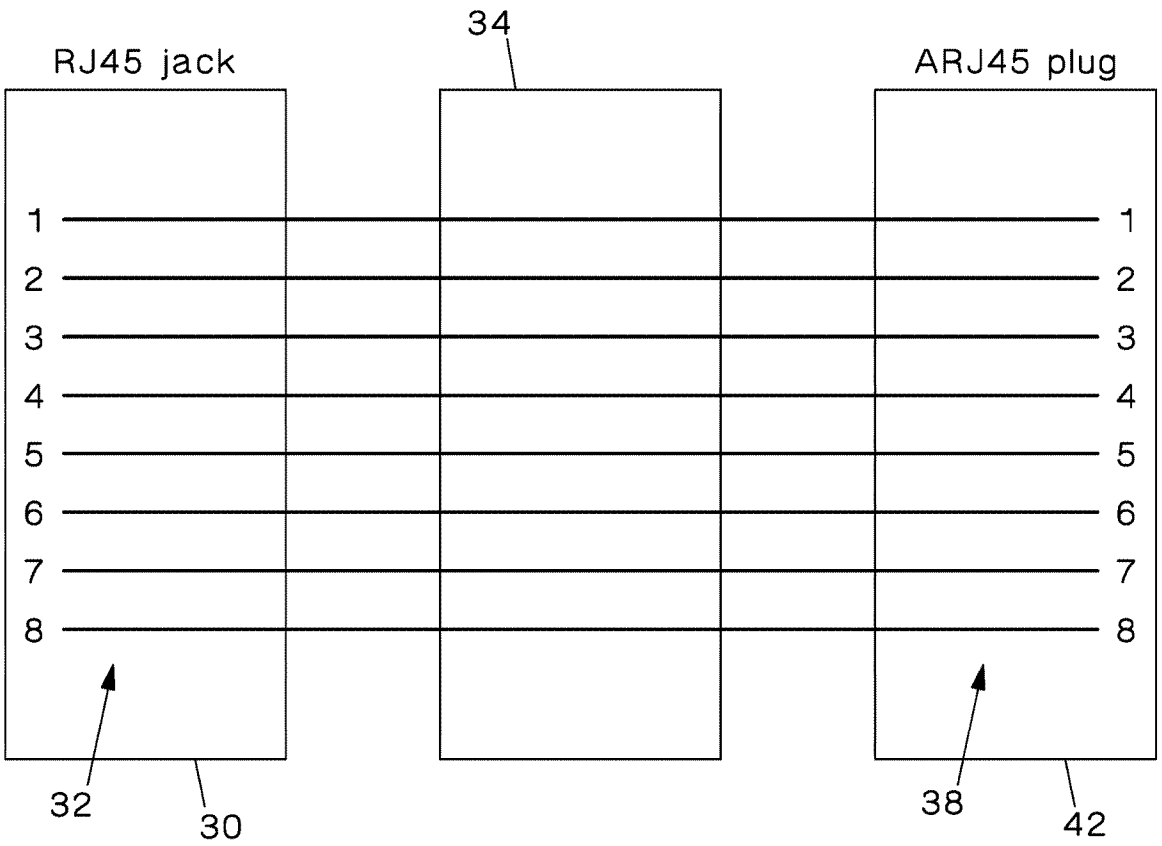
FIG. 5 is a schematic view of the adapter of FIG. 6.

An exploded view of the ARJ45 to RJ45 adapter 20 is shown in FIG. 4. Adapter 20 includes RJ45 housing 30, RJ45 nose with plug interface contacts 32, PCB 34 which connects the RJ45 jack contacts 32 to the ARJ45 plug contacts 38, ARJ45 plug contact support 36, ARJ45 plug contacts 38, ARJ45 plug latch 40, and ARJ45 plug housing 42. A schematic view of the ARJ45 to RJ45 adapter 20 is shown in FIG. 5 which view highlights the location of the RJ45 and ARJ45 interface, as well as the plug interface contacts 32, PCB 34, and ARJ45 plug contacts 38.

Because ARJ45 plug housing 42 can be metallic, or otherwise conductive, and provides isolation between the different wires of the ARJ45 plug contacts 38, plug housing 42 makes an ideal low noise end for the RJ45 contacts 32. Consequently, the addition of the ARJ45 to RJ45 adapter 20 does not provide any significant degradation to the 10GBASE-T signal passing through the adapter, beyond which is already anticipated by the RJ45 and ARJ45 respective standards.

For greenfield installations, where the 40GBASE-T servers are interfacing directly with a 40GBASE-T switch, adapters 20 may not be necessary. For brownfield installations where 40GBASE-T switches may interface with 10GBASE-T servers, users only need to buy as many adapters 20 as required to interface to corresponding server ports. Additionally, that same switch can interface with both 10GBASE-T and 40GBASE-T servers at the same time.

In another embodiment of adapter 20 the present invention may include magnetics such as isolation transformers.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communication adapter, comprising:

a registered jack type 45 (RJ45) jack including a plurality of plug interface contacts;

an augmented registered jack type 45 (ARJ45) plug including a plurality of plug contacts in electrical communication with respective said plug interface contacts;

a housing connecting said RJ45 jack to said ARJ45 plug; and a printed circuit board contained within the housing having circuitry connecting the plurality of plug interface contacts of the RJ45 jack with the plurality of plug contacts of the ARJ45 plug.

2. A communication system, comprising:

a communication equipment; and a communication adapter connected to said communication equipment, said communication adapter including a registered jack type 45 (RJ45) jack having a plurality of plug interface contacts, and augmented registered jack type 45 (ARJ45) plug including a plurality of plug contacts in electrical communication with respective said plug interface contacts, a housing connecting said RJ45 jack to said ARJ45 plug, and a printed circuit board contained within the housing having circuitry connecting the plurality of plug interface contacts of the RJ45 jack with the plurality of plug contacts of the ARJ45 plug.

* * * * *